US006233829B1

(12) United States Patent
Oglesby et al.

(10) Patent No.: US 6,233,829 B1
(45) Date of Patent: May 22, 2001

(54) RAZOR BLADE

(75) Inventors: Oliver David Oglesby, Basingstoke; Kevin James Wain, Reading, both of (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/197,151

(22) Filed: Nov. 20, 1998

Related U.S. Application Data

(63) Continuation of application No. PCT/US97/13157, filed on Jul. 28, 1997.

(30) Foreign Application Priority Data

Aug. 2, 1996 (GB) ..... 9616299

(51) Int. Cl.[7] ..... B26B 19/42
(52) U.S. Cl. ..... 30/34.2; 30/34.05; 30/50
(58) Field of Search ..... 30/32, 34.05, 34.2, 30/50

(56) References Cited

U.S. PATENT DOCUMENTS

| | | | | |
|---|---|---|---|---|
| 434,145 | * | 8/1890 | Gamble | 30/233.5 |
| 554,823 | * | 2/1896 | Kampfe | 30/63 |
| 1,190,182 | * | 7/1916 | McDonough | 30/30 |
| 2,298,508 | * | 10/1942 | Peters | 607/96 |
| 3,138,865 | | 6/1964 | Meyer | 30/34 |
| 3,593,416 | * | 7/1971 | Edson | 30/50 |
| 3,940,851 | * | 3/1976 | Rookus | 30/34.2 |
| 4,279,253 | * | 7/1981 | Haes et al. | 128/355 |
| 4,283,849 | * | 8/1981 | Engelhardt et al. | 30/43.6 |
| 4,443,939 | * | 4/1984 | Motta et al. | 30/49 |
| 4,516,320 | * | 5/1985 | Peleckis | 30/49 |
| 4,536,956 | * | 8/1985 | Koroncai et al. | 30/43.92 |
| 4,720,917 | * | 1/1988 | Solow | 30/49 |
| 5,138,767 | * | 8/1992 | Locke | 30/43.92 |
| 5,224,267 | * | 7/1993 | Simms et al. | 30/50 |
| 5,351,401 | * | 10/1994 | Werner | 30/50 |
| 5,560,105 | * | 10/1996 | Ichiyanagi | 30/77 |

FOREIGN PATENT DOCUMENTS 9529043 11/1995 (WO) .

* cited by examiner

*Primary Examiner*—Gregory L. Huson
*Assistant Examiner*—A. Dexter Tugbang
(74) *Attorney, Agent, or Firm*—Charles P. Boukus, Jr.; Donal B. Tobin

(57) ABSTRACT

A safety razor blade unit includes a hair pulling member (7) located immediately in front of the cutting edge of a blade (6), the hair pulling member (7) having slots (10) through which the hairs pass defined by a series of elements (9). The edges of the elements (9) which define the slots (10) are formed to notch the hairs as they pass through the slots, and trailing end portions (14) of the elements (9) are inclined to guide the hairs to follow a path for pulling the hairs from the skin just before they are cut through by the blade.

13 Claims, 4 Drawing Sheets

RAZOR BLADE

This application is a continuation of PCT/US97/13157 filed Jul. 28, 1997.

This invention relates to safety razors and in particular the invention is concerned with a blade unit having one or more elongate blades and a skin engaging member for engaging the skin in advance of a blade edge which is moved across the surface of the skin being shaved by means of a handle to which the blade unit is attached. The blade unit may be mounted on the handle to enable the blade unit to be replaced by a fresh blade unit when required. Replacement blade units are also commonly referred to as cartridges. Alternatively, a blade unit may be attached permanently to the handle with the intention that the entire razor should be discarded when the blade or blades have become dulled.

In general a blade unit has a guard for contacting the skin in advance of the blade edge(s) as the blades are moved across the skin during shaving, and a cap for contacting the skin behind the blade edge(s). Many different surface configurations and materials have been proposed for the guard surface. Thus guards have been designed to stretch the skin ahead of the blade, or to impart pleasant tactile sensations to the skin as the guard slides across its surface.

In our U.S. patent application Ser. No. WO 95/29043 there is described a blade unit having a skin engaging member for engaging the skin in advance of a blade edge, this member having a series of elements defining slots through which the hairs pass, and the elements being arranged to engage frictionally the hairs passing along the slots in order to apply a light pulling force on the hairs. The pulling force can increase the extension of the hairs from the skin before they are cut by the blade, without causing any noticeable discomfort.

The present invention is directed to an improved blade unit of the foregoing form and in accordance with the invention there is provided a blade unit comprising at least one blade with an elongate edge, a skin engagement surface for engaging the skin ahead of the blade edge during shaving, the skin engaging surface having slots for hairs to pass through, wherein the slot edges are formed to notch the hairs as they pass through the slots, and in the direction towards the blade, the slot edge formations are inclined for guiding the notched hairs to follow a path causing the extension of the hairs from the skin to be increased before the hairs are cut by the blade edge.

A blade unit according to the invention is adapted to exert a more positive pulling force for extending the hairs than is obtained by the previously proposed skin engaging member which relies solely on the friction between the sides of the slots and the hairs to resist the movement of the hairs with the skin as the skin slides over the skin engaging surface. With the present invention the hairs become notched and the edges of the slots can perform like rails to guide the hairs so that they are moved away from the skin and hence become pulled to increase their projecting length. Somewhat surprisingly this pulling effect, which enhances the closeness of the shave obtained by use of the blade unit, does not seriously impair the comfort level experienced during use of the blade unit.

In the presently preferred construction embodying the invention the skin engagement surface is defined by a series of elements between which the slots are formed, the elements having trailing end parts which extend from those parts thereof which define the surface and which are inclined downwardly, i.e. away from the skin in use of the blade unit. The slots taper in width across the skin engagement surface, but are of substantially constant width between the trailing end parts. For notching and subsequently guiding the hairs the elements have edge portions of reduced thickness conveniently provided by etching the undersides of the elements to form rebates. An appropriate edge thickness is around 20 microns or less. The reduced thickness edges of the trailing parts of the elements are inclined downwardly from the skin engagement surface at an angle of 30° to 70°, preferably between 40° and 60°.

The elements can be substantially rigid since the edges bite into the hairs and it is not crucial for the elements to deflect laterally to prevent hairs becoming jammed in the slots. However, a degree of resilience may be desirable and therefore the slot forming elements are preferably carried on springs, such as torsion springs connected to the leading ends of the element.

A full understanding of the invention will be gained from the detailed description of a particular embodiment which follows and in which reference is made to the accompanying drawings, wherein.

Figure 2:
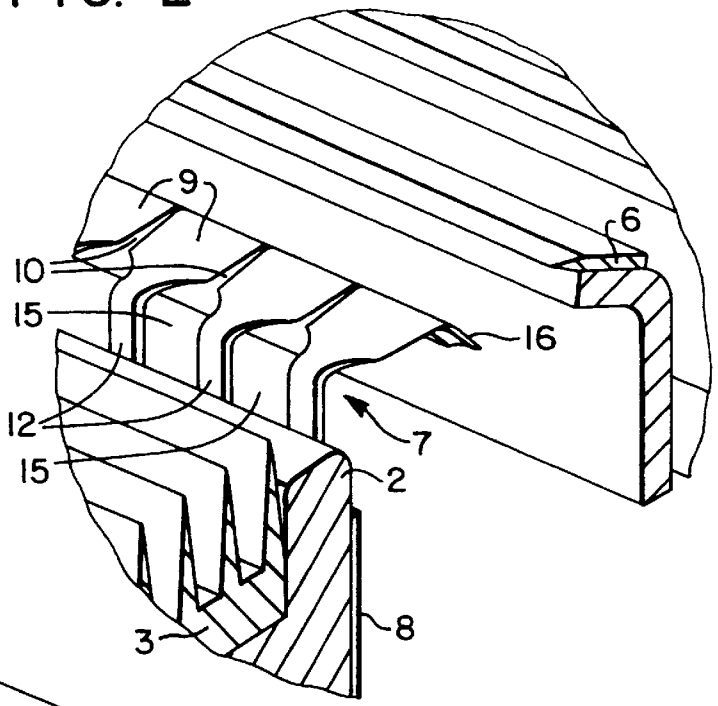
FIG. 2 shows the circled portion of FIG. 1 on an enlarged scale.
Figure 4:
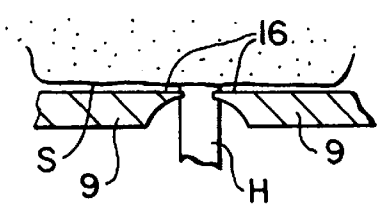
FIG. 4 is a detailed sectional view showing the engagement of a hair by edge portions of adjacent elements at a short distance from the trailing edge of the skin engagement surface.
Figure 3:
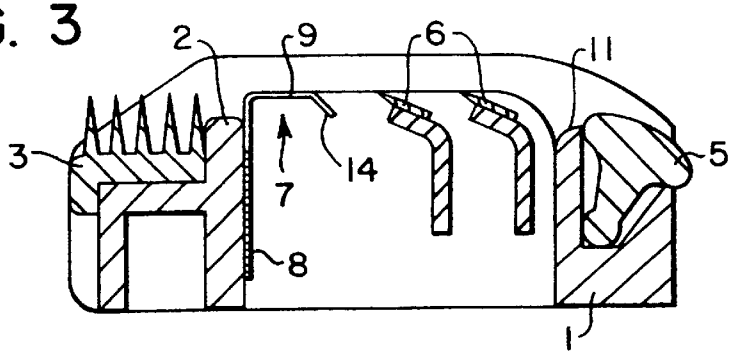
FIG. 3 is a transverse cross-section through the blade unit of FIG. 1.
Figure 1:
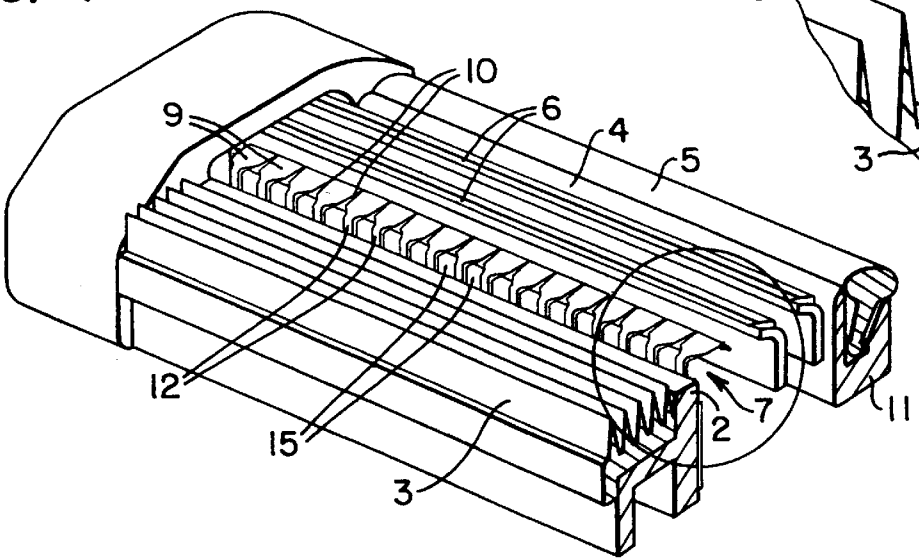
FIG. 1 is a partial isometric view of a blade unit embodying the invention.
Figure 7:
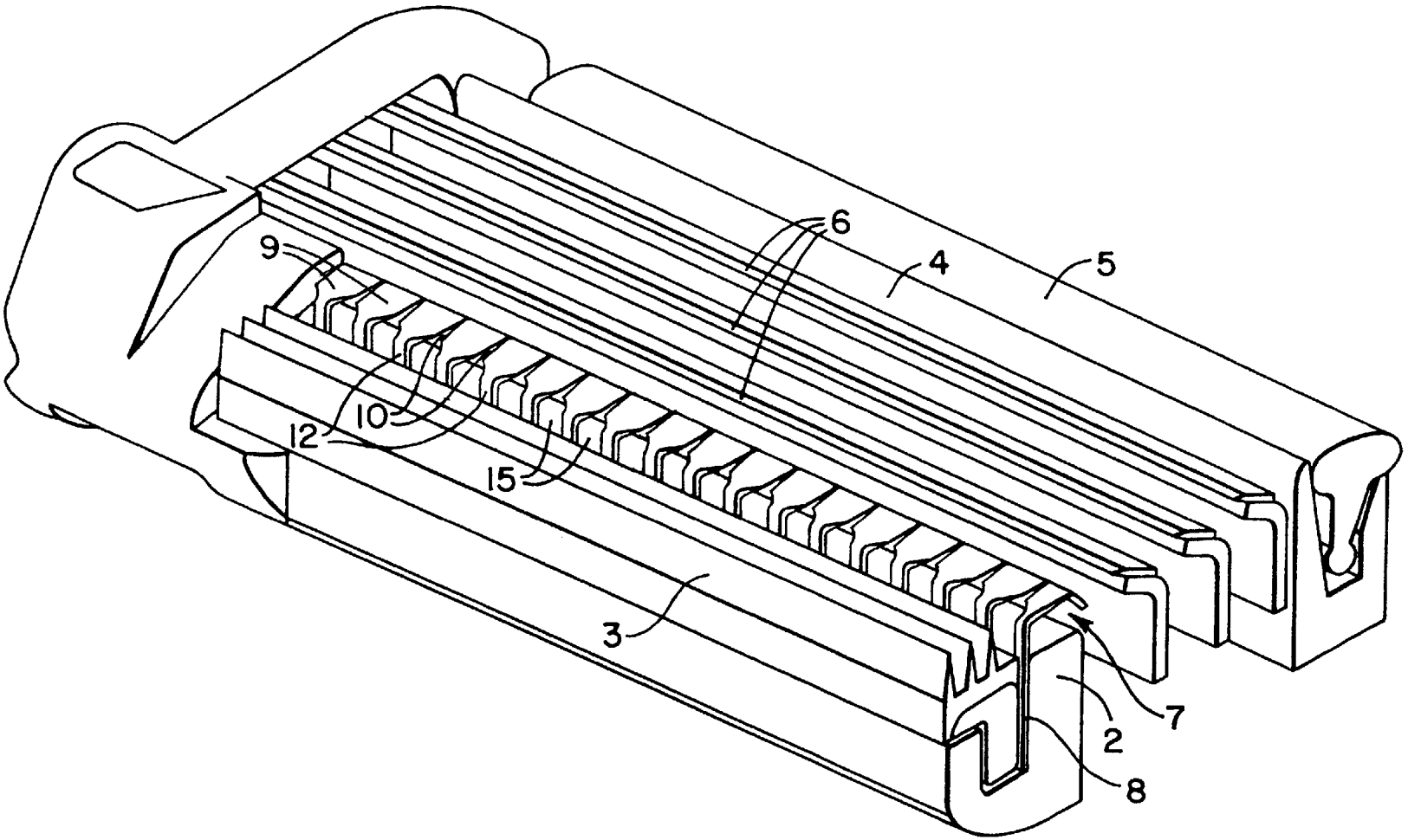
FIG. 7 is a view similar to FIG. 1 illustrating a modified embodiment of the invention.

The blade unit illustrated in FIGS. 1–3 may be a cartridge for detachable mounting on a re-usable handle, or it may be fixed to the handle of a disposable razor. It comprises a moulded plastic frame 1 the forward longitudinal rail of which forms a conventional guard bar 2 and carries a strip 3 of elastomeric material with upstanding fins extending lengthwise along the strip. The rear rail of the frame defines a cap surface 4 and carries a strip 5 of lubricating material. Within the opening of the frame is mounted a pair of elongate blades 6 with parallel cutting edges facing towards the guard. The blade unit also includes a pulling member 7 defining a skin engagement surface for engaging the skin being shaved in front of the cutting edge of the leading blade. As shown in FIGS. 1–3 the member 7 is supported on the rear face of the guard bar 2. In the modified construction shown in FIG. 7, the member 7 is supported on the front face of the guard bar 2 and extends rearwardly over the top of the guard bar. The hair pulling member has the form of an integral comb with a spine defining a front wall 8 secured to the guard bar 2, and a large number of identical elements or teeth 9 which define between them through-slots 10. The elements 9 are connected to the front wall 8 by respective stems 12 which are bent through 90° adjacent the elements 9 so that the elements define an upwardly facing engagement surface for engaging the skin during shaving. The trailing end parts 14 of the elements are downwardly inclined from the skin contacting surface at an angle in the range of 40° to 60°. The support stems 12 are relatively narrow defining intervening gaps 15 of substantially greater width than the stems themselves so that hairs will tend to pass into the gaps rather than being flattened against the skin by the stems. The gaps 15 lead into the slots 10, the transition between the gaps and slots being shaped to funnel the hairs into the mouths of the slots The slots, taper in width from their mouths at the leading edge of the skin engagement surface to the trailing edge of this surface at which the trailing end parts 14 of the elements extend away from the surface. The slots are of substantially constant width, e.g. in the range of 30–60 microns along their sections defined between the inclined end parts 14 of the elements 9. The edges 16 of the elements 9 confining the slots are shaped so that they will penetrate the surfaces of the hairs as they move through the slots, the edges 16 thereby becoming positively engaged with the hairs by notching into the hairs as illustrated in FIG. 4. By this positive engagement, the edges 16 of the inclined parts 14 act as rails and guide the hairs H passing along the slots so that they are pulled from the skin S which is not able to follow the path of the hairs, and as a consequence the hair extension, i.e. the length of the hair protruding from the skin, is increased at a position directly in front of the edge of the blade positioned behind the hair pulling member. The hairs pass out of the slots before they are cut so there is no possibility for cut hairs to become trapped in the slots.

Figure 8:
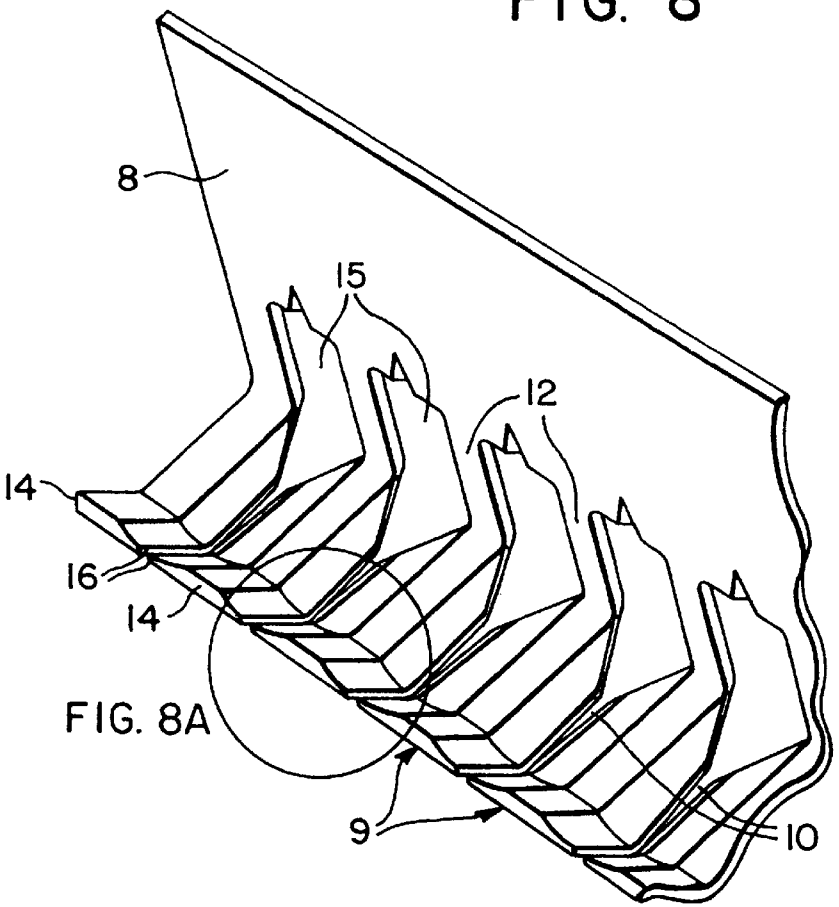
FIG. 8 is an isometric view showing the underside of a section of skin engagement member with hair pulling elements according to the invention.
Figure 8A:
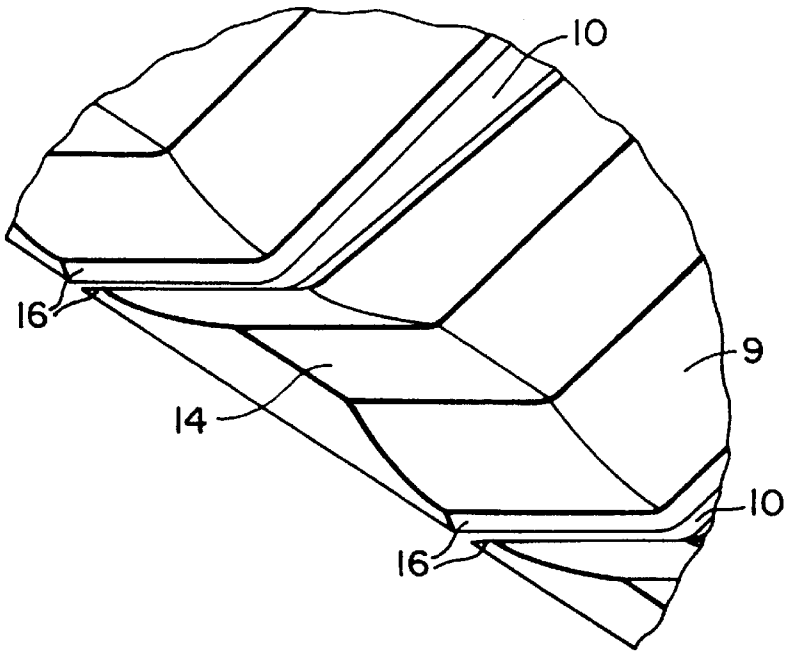
FIG. 8A shows the circled part of FIG. 8 on a larger scale.

The reduced thickness edges of the elements 9 can be conveniently formed by making the hair pulling member from a metal sheet which is etched onto the underside to produce areas of reduced thickness in the regions of the slots 10 which are subsequently formed by laser cutting along the etched areas. In this way rebates are created along the edges at the undersides of the elements 10. There are of course alternative ways to produce effective edge profiles or formations, such as by shaping the edges by means of a grinding wheel. The edges 16 can be shaped with their lateral faces at an angle so that the confronting extreme edges converge towards the skin engagement surface, as clearly visible in FIGS. 8 and 8A which show a section of a hair pulling member from the underside. The edges should be sharp enough to bite into the hairs, but not so sharp that they will cause the hairs to be cut through. An edge thickness of about 20 microns or less is appropriate.

The elements 9 of the hair pulling member may be rigidly supported. It is in any event necessary for the elements to be arranged to press against the hairs with sufficient force to cause the edges of the elements to bite into the hairs. However, in order to preclude excessive resistance to hairs of large diameter it is preferable for the elements to be capable of some resilient movement In the illustrated embodiment this is achieved by the stems 12 acting as torsion springs by being capable of twisting resiliently about their respective upwardly extending longitudinal axes.

Although the hair pulling member is shown mounted in front of the leading blade in the blade unit of FIGS. 1 to 3, a similar hair pulling member could additionally or alternatively be mounted in the frame directly in front of the second blade, or indeed any further blade which might be provided in the shaving unit.

Figure 5:
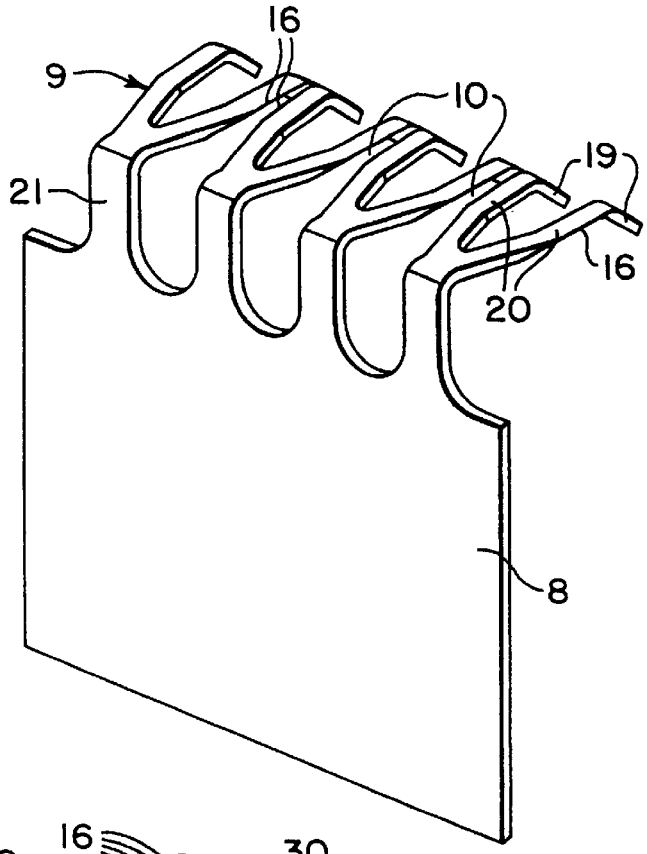
FIGS. 5 and 6 show in perspective sections of modified forms of the hair pulling member of FIGS. 1 to 3.
Figure 6:
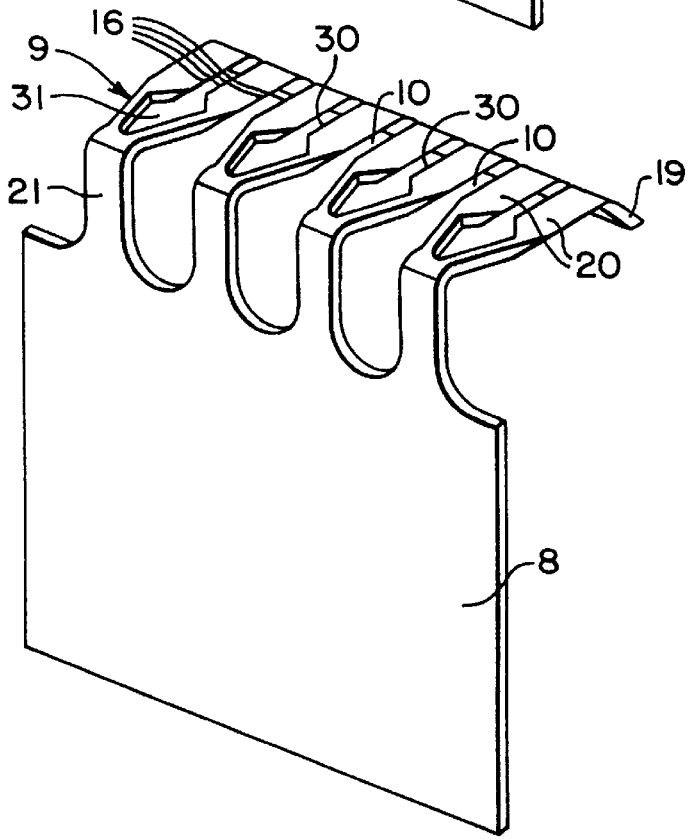

The hair pulling member can take different forms to that shown in FIGS. 1–3 and two modified constructions are illustrated in FIGS. 5 and 6. The elements 9 have a reduced thickness at the edges of the slots 10 and the hair pulling members of FIGS. 5 and 6 will function to pull hairs in the manner described above. In the modification of FIG. 5, the elements are bifurcated so that the parts forming the skin engagement surface have the shape of a Y as seen in plan. The divergent prongs 20 can be stiff so that the stems 21 act as torsion springs, or the prongs can be resilient to at least contribute to lateral deflection when desired, e.g. due to large diameter hairs passing through the slots. The downwardly inclined tail parts 19 of the prongs are parallel. The hair pulling member shown in FIG. 6 is generally similar to that of FIG. 5, but the prongs 20 of each element 9 are shaped to form an additional slot 30 and a diamond shaped hole 31 at the forward end of this slot. Hairs which fail to enter the slots 10 can enter these additional slots 30 which like the slots 10, are confined between edges 16 of reduced thickness so that the edges notch into the hairs and cause them to be pulled by the downwardly inclined tail parts 19 of the prongs in the same way as the hairs passing through the slots 10 are pulled.

There are, of course, other ways of constructing the hair pulling member, and it could for example take the general form of any of the embodiments of the skin engaging members described in WO 95/29043, the contents of which are incorporated herein by this reference, always provided that the elements which provide the skin engagement surface have slot edge profiles so that the edges notch into the hairs, and these elements are extended by downwardly inclined rear parts which are directed away from the skin engaging surface.

While it is apparent that modifications and changes can be made within the spirit and scope of the present invention, it is our intention, however, only to be limited by the appended claims. One possible modification to the described embodiments would be for the hair pulling member to be movably mounted in the frame of the blade unit, in particular for movement in a direction towards and away from the skin sliding over the elements of the hair pulling member, the hair pulling member being acted on by a spring or springs which urge the member upwardly towards the skin.

What is claimed is:

1. A safety razor blade unit comprising at least one blade with an elongate edge, a skin engagement surface for engaging the skin ahead of the blade edge during shaving, the skin engaging surface comprising a series of elements defining a plurality of slots therebetween for hairs to pass through, wherein each slot has opposed edges formed to notch the hairs as the hairs pass through the slots in the direction towards the blade, the opposed slot edges comprising edge portions of the elements having reduced thickness for notching the hairs, and the opposed slot edges being inclined away from the skin engaging surface for guiding the notched hairs to follow a path causing the extension of the hairs from the skin to be increased before the hairs are cut by the blade edge.

2. A safety razor blade unit according to claim 1, wherein the inclination of the slot edges is in the range of 30° to 70° to the skin engagement surface.

3. A safety razor blade unit according to claim 1, wherein the inclination of the slot edges is in the range of 40° to 60° to the skin engagement surface.

4. A safety razor blade unit according to claim 1, wherein the skin engagement surface is formed by a series of elements between which the slots are formed, the elements having downwardly inclined parts extending from the surface defining parts in the direction towards the blade.

5. A safety razor blade unit according to claim 4, wherein the width of the slots tapers from the leading edge of the skin engagement surface to a minimum value less than the diameter of a hair, and the adjacent elements are resiliently movable relative to each other substantially parallel to the plane of the surface.

6. A safety razor blade unit according to claim 4, wherein the slot sections defined between the inclined parts are of substantially constant width.

7. A safety razor blade unit according to claim 4, wherein the elements are provided by respective teeth of a comb-like member.

8. A to make dull/blunt safety razor blade unit according to claim 1, wherein the reduced thickness edges are formed by rebates on the undersides of the elements.

9. A safety razor blade unit according to claim 8, wherein the rebates are etched surface portions.

10. A safety razor blade nit according to claim 1 wherein the edge thickness is not greater than approximately 20 microns.

11. A safety razor blade unit according to claim 1, wherein the surface elements are supported by respective springs.

12. A safety razor blade unit according to claim 10, wherein the springs are torsion springs connected to the elements at the forward ends thereof.

13. A safety razor blade unit according to claim 1, wherein the opposed slot edges are shaped for penetrating the surfaces of the hairs to positively engage the hairs by notching into the hairs passing through the slots to pull the notched hairs from the skin and increase the protruding length of the hairs in front of the blade edge.

* * * * *

UNITED STATES PATENT AND TRADEMARK OFFICE

CERTIFICATE OF CORRECTION

PATENT NO. : 6,233,829 B1
DATED : May 22, 2001
INVENTOR(S) : Oliver David Oglesby et al.

It is certified that error appears in the above-identified patent and that said Letters Patent is hereby corrected as shown below:

Column 5,
Line 4, delete "to make dull/blunt".
Line 9, change "nit" to -- unit --.

Signed and Sealed this

Twenty-third Day of April, 2002

*Attest:*

*Attesting Officer*

JAMES E. ROGAN
*Director of the United States Patent and Trademark Office*